US006227288B1

(12) United States Patent
Gluck et al.

(10) Patent No.: US 6,227,288 B1
(45) Date of Patent: May 8, 2001

(54) MULTIFUNCTIONAL CAPILLARY SYSTEM FOR LOOP HEAT PIPE STATEMENT OF GOVERNMENT INTEREST

(75) Inventors: Donald F. Gluck; Charlotte Gerhart, both of Albuquerque, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/562,873

(22) Filed: May 1, 2000

(51) Int. Cl.[7] ..... F28D 15/00
(52) U.S. Cl. ..... 165/104.26; 165/911
(58) Field of Search ..... 165/104.26, 907, 165/104.21, 911; 126/45, 96; 431/298, 302, 303, 323

(56) References Cited

U.S. PATENT DOCUMENTS

| | | | | |
|---|---|---|---|---|
| 3,603,382 | * | 9/1971 | Paine et al. | 165/104.26 |
| 3,789,920 | * | 2/1974 | Low et al. | 165/104.26 |
| 3,952,798 | * | 4/1976 | Jacobson et al. | 165/104.26 |
| 4,351,388 | * | 9/1982 | Calhoun et al. | 165/104.26 |
| 4,903,761 | * | 2/1990 | Cima | 165/104.26 X |
| 4,957,157 | * | 9/1990 | Dowdy et al. | 165/104.26 X |

FOREIGN PATENT DOCUMENTS

| | | | | |
|---|---|---|---|---|
| 0210337 | * | 4/1986 | (EP) | 165/104.26 |
| 0544852 | * | 1/1977 | (SU) | 165/104.26 |
| 0775607 | * | 10/1980 | (SU) | 165/104.26 |
| 0805046 | * | 2/1981 | (SU) | 165/104.26 |
| 0823811 | * | 4/1981 | (SU) | 165/104.26 |
| 001815586 | * | 5/1993 | (SU) | 165/104.26 |

OTHER PUBLICATIONS

Yuri Maidanik et al, Institute of Thermal Physics, Ural Division of Russian Academy of Sciences, Technical Report for Stage 2 of Project No. 473 for the International Science and Technology Center, Moscow, Russia, 1997.

* cited by examiner

*Primary Examiner*—Christopher Atkinson
(74) *Attorney, Agent, or Firm*—Kenneth E. Callahan

(57) ABSTRACT

A Multifunctional Capillary System is located within and between a single compensation chamber (CC) and the evaporator of a loop heat pipe. It provides: vapor-liquid interface control for all gravity states from the micro-gravity condition of space (near 0-g) through the earth's gravitational condition (1-g), with liquid supply to the evaporator via wicking from the CC in micro-gravity, and for all orientations (tilts) of the CC-evaporator assembly in earth gravity. As a single compensation chamber is used, dual compensation chamber penalties of weight and wide-temperature-variation are avoided. The system has combined, parallel wicking structure, paths, and joints for micro-gravity and 1-g liquid acquisition. The wick system is comprised of an axial-groove, evaporator-core secondary wick—concentric, contiguous, and in intimate contact with the primary evaporator wick. This secondary wick mates to a porous vane assembly in the CC. The design provides wicking continuity at this and at other joints within the system. In both the micro-gravity environment and under worst case 1-g orientation (CC below evaporator) the design can supply liquid to the primary wick under a wide range of temperature and power for steady state, startup, and transient conditions.

9 Claims, 19 Drawing Sheets

Section 6-6

Section 5-5

Design Parameters for a Specific Embodiment of the Invention

| **COMPENSATION CHAMBER** | | **EVAPORATOR** | |
|---|---|---|---|
| Case Material | Stainless Steel | Case Material | Stainless Steel |
| Length | 74 mm | Length | 203 mm |
| Internal Diameter | 62 mm | Internal Diameter | 22 mm |
| Volume | 223 cu cm | Volume | 77.2 cu cm |
| **Slotted Tube** | | **Primary Wick** | |
| Length/ID/OD | 80.4/7/8 mm | Pore Diameter | 16 microns |
| Shape of Slots | Oval | Permeability | $8 \times 10^{-14} m^2$ |
| Typical Dimensions | 7/2.5 mm | Active Length/ID/OD | 187.5/12/22 mm |
| Number of | 68 per Tube | Vapor Grooves | 20 of |
| **Vane Assembly** | 9 of | Depth/Width | 1.0/1.0 mm |
| **Vanes** | 2 of | **Secondary Wick** | Five Layers, Incremental Porosity |
| Pore Diameter | 388 microns | First Layer (CC Side) | |
| Permeability | $1.6 \times 10^{-9} m^2$ | Pore Diameter | 388 microns |
| Length/Width/Thickness | 27.2/74/0.45 mm | Permeability | $1.6 \times 10^{-9} m^2$ |
| Slots | | Fifth Layer (Evap. Side) | |
| Number/Height/Width | 7 of3.3mm/6.35mm | Pore Diameter | 18 microns |
| **Vane Risers** | 16 | Permeability | $2.6 \times 10^{-12} m^2$ |
| Length/Width/Thickness | 22.9/6.35/0.45mm | Active Length/ID/OD | 187.5/8/12 mm |
| **Spacers** | 7 of | Axial Grooves | 9 of, Trapezoidal |
| Diameter/Thickness | 6.35/1.05mm | Depth | 1.05 mm |
| | | Inner /Outer Width | 1.05/1.25 mm |

*Fig. 16*

MULTIFUNCTIONAL CAPILLARY SYSTEM FOR LOOP HEAT PIPE STATEMENT OF GOVERNMENT INTEREST

STATEMENT OF GOVERNMENT INTEREST

The invention described herein may be manufactured and used by or for the Government for governmental purposes without the payment of any royalty hereon.

BACKGROUND OF THE INVENTION

1. Field of the Invention

The invention is in the field of heat transmission and transport using loop heat pipes.

2. Description of the Prior Art

The loop heat pipe (LHP) is a thermal control and heat transport device initially developed in Russia. Its original purpose was to provide passive (no moving parts) cooling for a missile. It was later used by the Russians for spacecraft cooling. It has since been fabricated and tested by companies in the U. S. It has been space flight tested in Space Shuttle Hitchhiker Canisters and will be used in a number of spacecraft missions. The LHP can transport large quantities of heat over long distances with moderate temperature difference, and can be designed to be mechanically flexible.

FIG. 1 shows a schematic of a typical LHP. It consists of an evaporator with a porous wick, a contiguous compensation chamber, condenser, and vapor and liquid transport lines. A two-phase (liquid and vapor) working fluid, such as ammonia, is used. Heat applied at the evaporator wall causes vaporization of the liquid at the outer surface of the wick. This vaporization and fluid surface tension causes a curved meniscus to form in the wick. The pressure rise due to this curved meniscus drives fluid to circulate about the loop. The smaller the pore size of the wick, the greater the pressure rise that can be generated. Heat removal causes the liquid to condense, and sets up a steady fluid motion.

FIG. 2 is a scanned image of a photograph of the evaporator-compensation chamber assembly (including heater plate) of a Russian LHP. The compensation chamber is a separate element with a larger diameter than the evaporator. FIG. 3 shows a possible adverse vapor-liquid configuration in this assembly in the micro-gravity (near 0-g) condition of space. This configuration is adverse in that the liquid in the compensation chamber is separate from and does not wet the evaporator wick. Of course, other vapor-liquid configurations in micro-gravity, many of which wet the wick, are possible. However, spacecraft components must always be designed to operate under the worst possible condition. Similarly, FIG. 4 shows an adverse vapor-liquid configuration in 1-g (earth gravity); this is caused by the orientation (tilt) of the assembly with respect to the earth's gravity vector. Other orientations in earth gravity, as shown for example by the horizontal orientation of FIG. 5, can result in an acceptable vapor-liquid location. Because of evaporator non-wetting illustrated by FIG. 4, LHP usage in 1-g conditions has been constrained to orientations that are near horizontal or where the compensation chamber is above the evaporator.

The above noted deficiencies of LHPs have prompted both Russian and U. S. researchers to seek corrective measures. These have usually consisted of the incorporation of an auxiliary or secondary wick. The principal behind this secondary wick is illustrated by FIG. 6. This shows liquid flowing under capillary pressure from a larger to a smaller pore. The pressure drop going from vapor to liquid in the large and small pores is given by $\Delta P_1=2\sigma \cos \theta_1/R$ and $\Delta P_2=2\sigma \cos \theta_2/r$, respectively. Here $\sigma$ is the surface tension, $\theta$ the contact angle, and R and r are the radii of curvature, respectively. With the vapor pressure the same in the two pores, $\Delta P_1=P_v-P_{L1}$ and $\Delta P_2=P_v-P_{L2}$. Equating $P_v$ in the two equations for the same contact angle, $\theta$, in the two pores, there results $P_{L1}-P_{L2}=2\sigma \cos \theta(1/r-1/R)$. Pressure within the liquid is higher in the large pore than in the small one and hence liquid flow ensues in that direction.

The Russian version of this wick follows from their powder metal technology. FIG. 7 shows two such wicks, one for each compensation chamber in a dual compensation chamber LHP. The wicks, shown by the coarse crosshatching, occupy the annular region of each compensation chamber, butting against the main or primary wick in the evaporator. Properties of these wicks are: 93% porosity, 600 microns effective pore diameter, and $1.5\times10^{-5}$ meter$^2$ permeability. For comparison the corresponding properties of the primary wick, the driving capillary force in the LHP, are: 72% porosity, 2.3 microns effective pore diameter, and $4\times10^{-14}$ meter$^2$ permeability.

The secondary wick of FIG. 7, by containing liquid within its pores, does provide interface control within the compensation chamber. However, as regards the liquid supply to the evaporator, its properties are a compromise between micro-gravity and 1-g requirements, and thus do justice to neither. Moreover, the design is deficient in that the secondary wick merely butts, but does not overlap, the primary evaporator wick.

In micro-gravity, capillary driven flow must overcome only the pressure loss in the medium through which it is flowing, i.e., there is no hydrostatic (gravity) head loss. The capillary pressure difference driving the flow is given for liquids that wet perfectly by $\Delta P=4\sigma/d$, while the laminar flow pressure loss is given by $\Delta P=\mu uL/K$. Here, $\sigma$ is the surface tension, d is the pore diameter, $\mu$ is the liquid viscosity, u is the liquid velocity, L is the length traversed, and K is the permeability. The permeability is inversely proportional to the flow resistance of the medium and is given by $K=\epsilon d_h^2/32$, where $\epsilon$ is the porosity and $d_h$ the hydraulic diameter of the medium. For randomly packed spheres permeability is given approximately by $K=0.00667d^2\epsilon^3/(1-\epsilon)^2$. Solving for the resultant velocity in the medium, it is found that $u=(4)(0.00667)\sigma d\epsilon^3/\mu L(1-\epsilon)^2$. Thus it is seen that velocity increases as pore diameter, d, increases.

In 1-g, capillary driven flow must overcome both flow pressure loss and hydrostatic head due to gravity. Velocity is now given by $u=[0.00667\sigma d^2\epsilon^3/\mu L(1-\epsilon)^2][4\sigma/d-\Delta\rho gL]$, where $\Delta\rho$ is the difference between liquid and vapor density, and g is the acceleration due to earth gravity, 9.8 meter/second$^2$. The dependence of liquid velocity on pore diameter is now more complex. Indeed, unless the pore diameter is sufficiently small such that $4\sigma/d$ is greater than $\Delta\rho gL$ there is no flow. Where the hydrostatic term, $\Delta\rho gL$, becomes significant, pore diameter must be small rather than large to cause liquid to flow. This is just the opposite of the result found for the micro-gravity case. Thus, the design approach taken entails the choice of secondary wick pore size that is a compromise between two conflicting requirements.

With an analysis similar to that above for effective pore diameter, it can be shown that it is much preferred that the secondary wick overlap the primary wick, rather than butting it. It was seen above that the permeability of the secondary wick can be orders of magnitude greater than that of the primary wick ($1.5\times10^{-5}$ versus $4\times10^{-14}$ meter$^2$). With overlap, the supply liquid within the secondary wick encounters much less flow resistance in reaching the far end of the primary wick than if it had to traverse the much denser primary wick. The overlapping wick does, however, suffer from the pore diameter compromise discussed above.

The U.S. approach to secondary wick design is closely held and rarely revealed. However, the designs appear to use 100 to 200 mesh screens rolled or formed to create channels or arteries. They appear to extend from the compensation chamber along most of the length of the primary wick, making only partial or sector contact.

Designs of this type cannot have much of a static wicking height capability, as pore size is determined by the gap between the screen layers. At best, this gap can be taken to be of the order of the wire diameter, 114 microns for a 100-mesh screen. The resultant static wicking height in ammonia at 25° C. is 2.6 cm.

These designs are then primarily for micro-gravity or for near horizontal orientations of the compensation chamber-evaporator assembly in 1-g. They are of little or no utility for compensation chamber-evaporator orientations where the compensation chamber is below the evaporator. Additionally, contact between the secondary and primary wicks within the evaporator appears to be irregular, sector contact.

An alternate approach for liquid supply to the evaporator wick for any orientation of the compensation chamber-evaporator assembly in 1-g is the use of dual compensation chambers. Such an assembly was shown in FIG. 7. (Yuri Maidanik et al, Institute of Thermal Physics, Ural Division of Russian Academy of Sciences, Technical Report for Stage 2 of Project No. 473 for the International Science and Technology Center, Moscow, Russia, 1997). A photograph of the entire LHP with this assembly is shown in FIG. 8. The premise behind this design is that, for orientations of the assembly away from the horizontal, one of the two compensation chambers is always above the evaporator. Possible orientations of a dual compensation chamber LHP are shown in FIG. 9.

The obvious penalty of a dual compensation chamber LHP is the weight of the second compensation chamber and the liquid contained therein. Recent performance tests at the Air Force Research Laboratory have revealed an additional, significant penalty. This is shown, for example, for a −40° C. condenser temperature in FIG. 10, where steady-state saturation temperature is plotted against power for the nine orientations of FIG. 9. Saturation temperature is seen to vary widely. For orientations 5, 6 and 8—whose common feature is a vertical evaporator with liquid return from below—this temperature is always hotter than the ambient (18 to 23° C.). For orientations 3, 4, and 7—whose common feature is condenser above evaporator—this temperature can be quite cold, approaching −30° C. at low power. For a number of applications such wide temperature variation is a serious problem or is entirely unacceptable.

SUMMARY OF THE INVENTION

The invention is a multifunctional capillary system located within and between a single compensation chamber and the evaporator of a loop heat pipe. It provides vapor-liquid interface control for all gravity states from the micro-gravity condition of space (near 0-g) to 1-g at the earth's surface while supplying liquid to the evaporator via wicking from the compensation chamber in micro-gravity and for all orientations of the compensation chamber-evaporator assembly in earth gravity. Since a single compensation chamber is used, dual compensation chamber penalties of weight and wide-temperature-variation are avoided. The system has a combined, parallel wicking structure and parallel paths for micro-gravity and 1-g liquid acquisition. The wick system is comprised of an axial-groove, evaporator-core secondary wick—concentric, contiguous, and in intimate contact with the primary evaporator wick. This secondary wick mates to a porous vane assembly in the compensation chamber. The design provides wicking continuity at this and at other joints within the system. In both the micro-gravity environment and under the worst case 1-g orientation (compensation chamber below evaporator), the multifunctional capillary system is capable of hundreds of Watts of power load under steady state, startup, and transient conditions.

BRIEF DESCRIPTION OF THE DRAWINGS

The various features of novelty that characterize the invention are pointed out with particularity in the claims annexed to and forming a part of this disclosure. For a better understanding of the invention, its operating advantages, and specific objects attained by its uses, reference is made to the accompanying drawings and descriptive matter in which a preferred embodiment of the invention is illustrated.

FIG. 16 is a table specifying design parameters for a specific embodiment of the invention.

DETAILED DESCRIPTION

Figure 1:
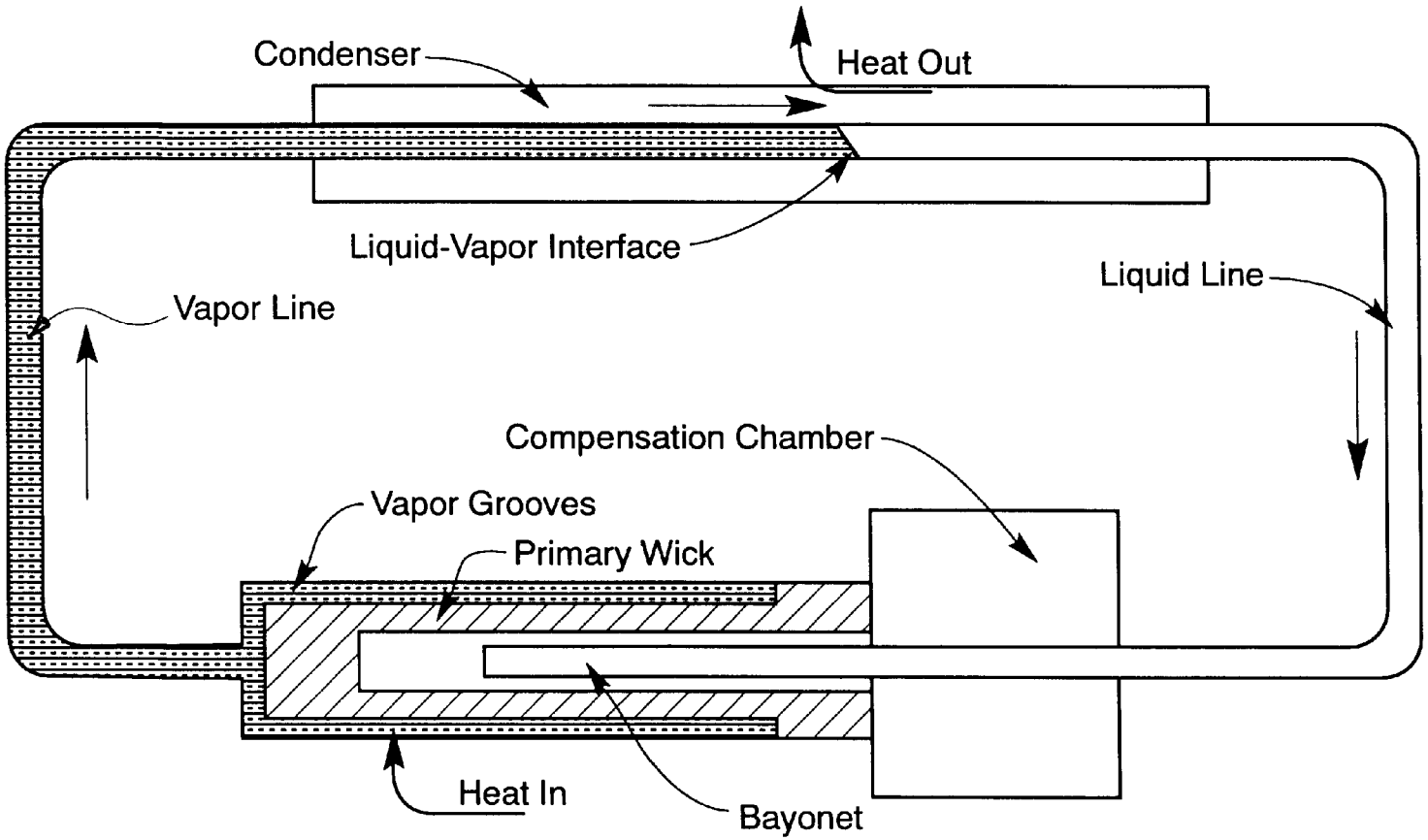
Fig. 1 PRIOR ART
FIG. 1 is a schematic of a typical loop heat pipe.
Figure 2:
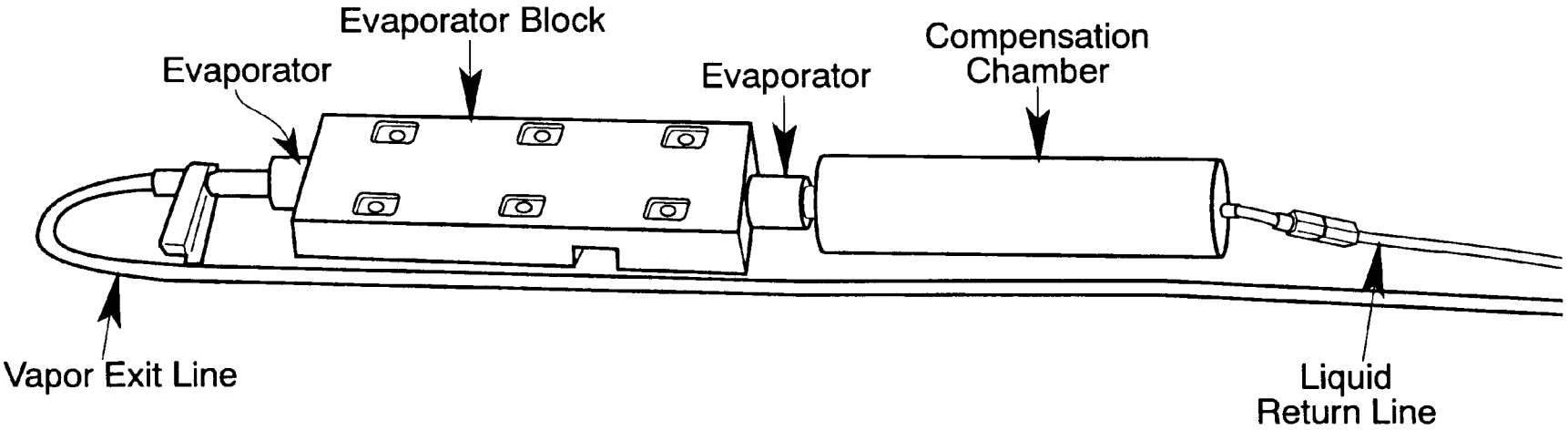
Fig. 2 PRIOR ART
FIG. 2 is a scanned image of a photograph of a Russian loop heat pipe evaporator assembly.
Figure 3:
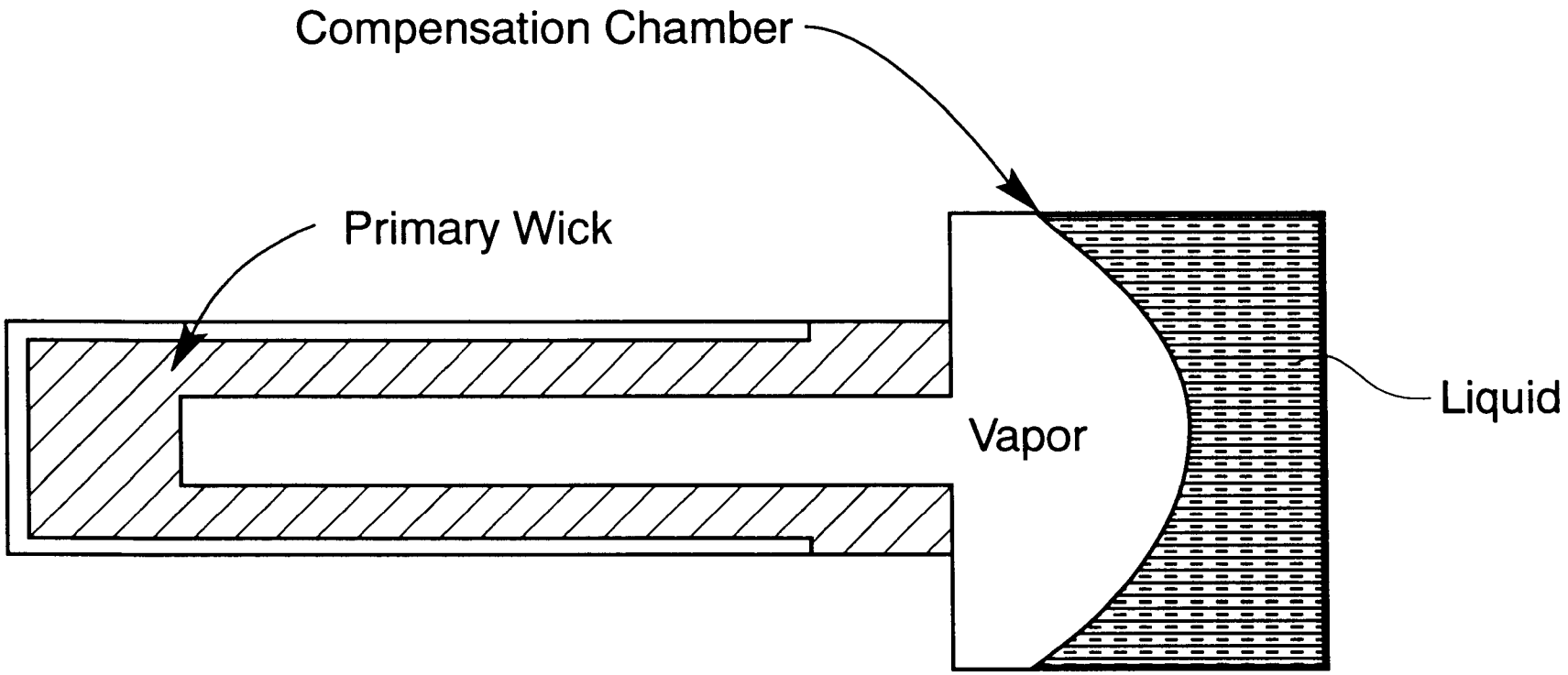
FIG. 3 shows an adverse vapor-liquid configuration for a LHP in micro-gravity.
Figure 4:
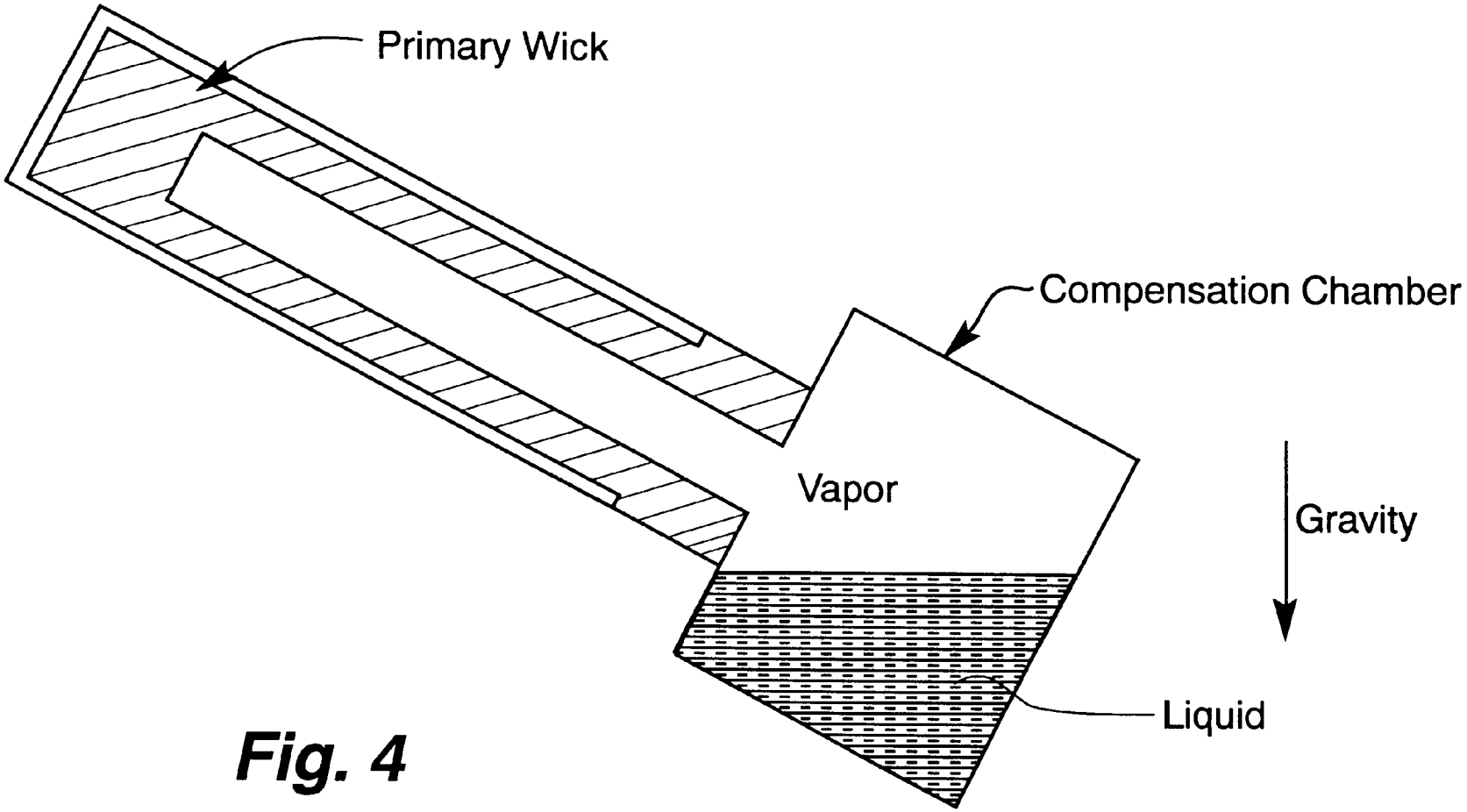
FIG. 4 shows an adverse vapor-liquid configuration for a LHP in earth gravity.
Figure 5:
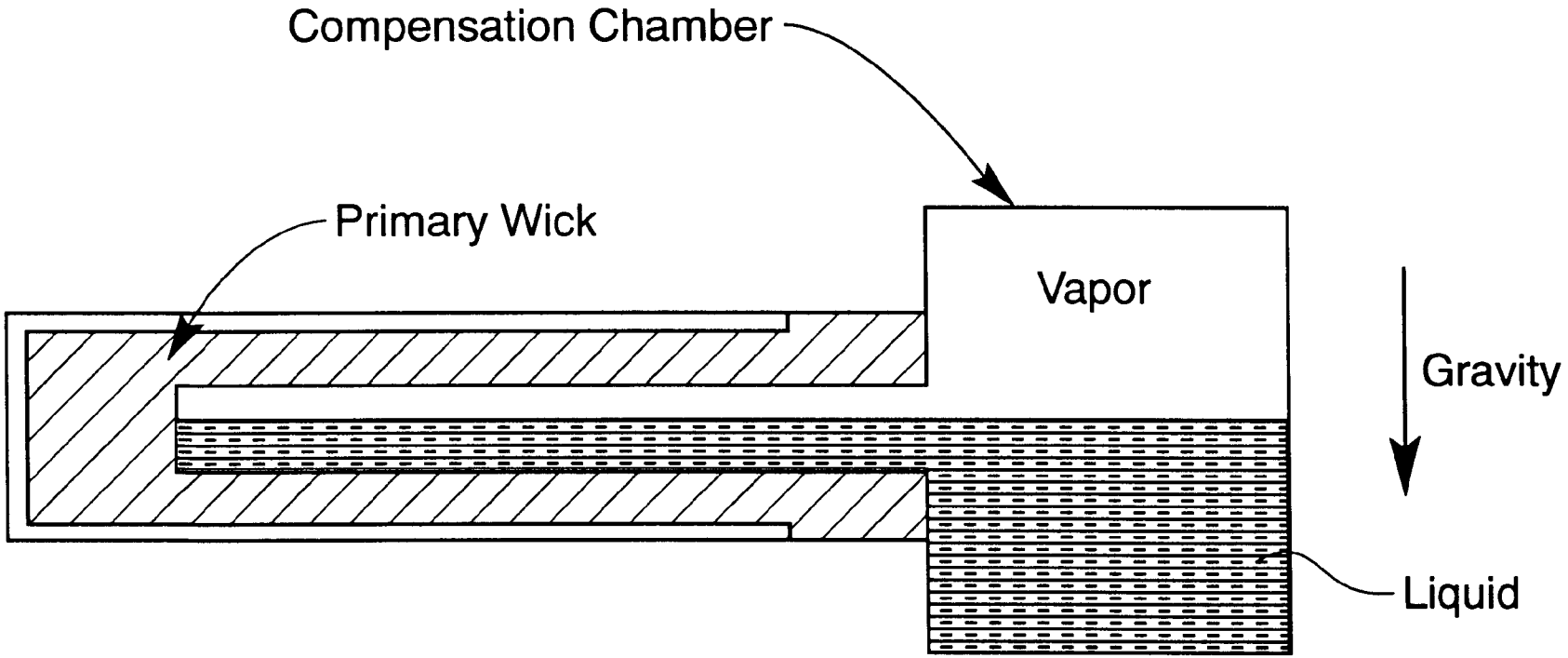
FIG. 5 shows an acceptable vapor-liquid configuration for a LHP in earth gravity.
Figure 6:
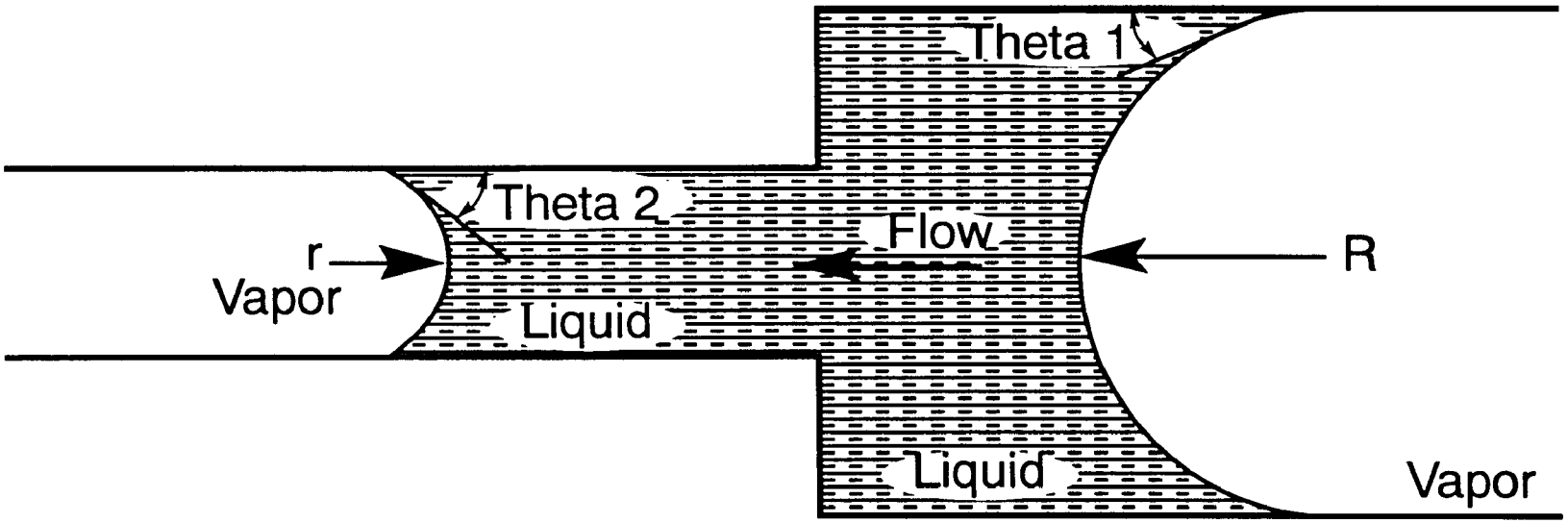
FIG. 6 demonstrates the principle of operation of a secondary wick.
Figure 7:
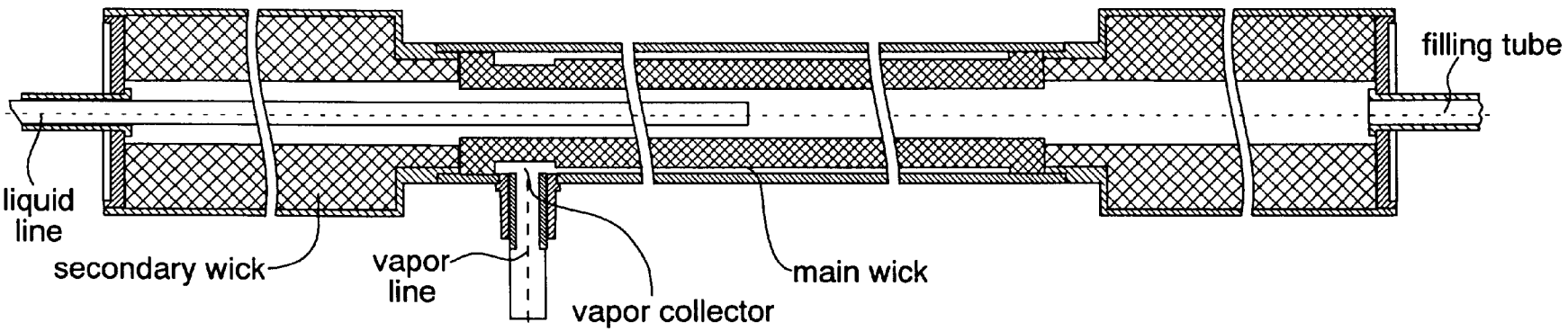
Fig. 7 PRIOR ART
FIG. 7 is a diagram section of a Russian dual compensation chamber LHP.
Figure 8:
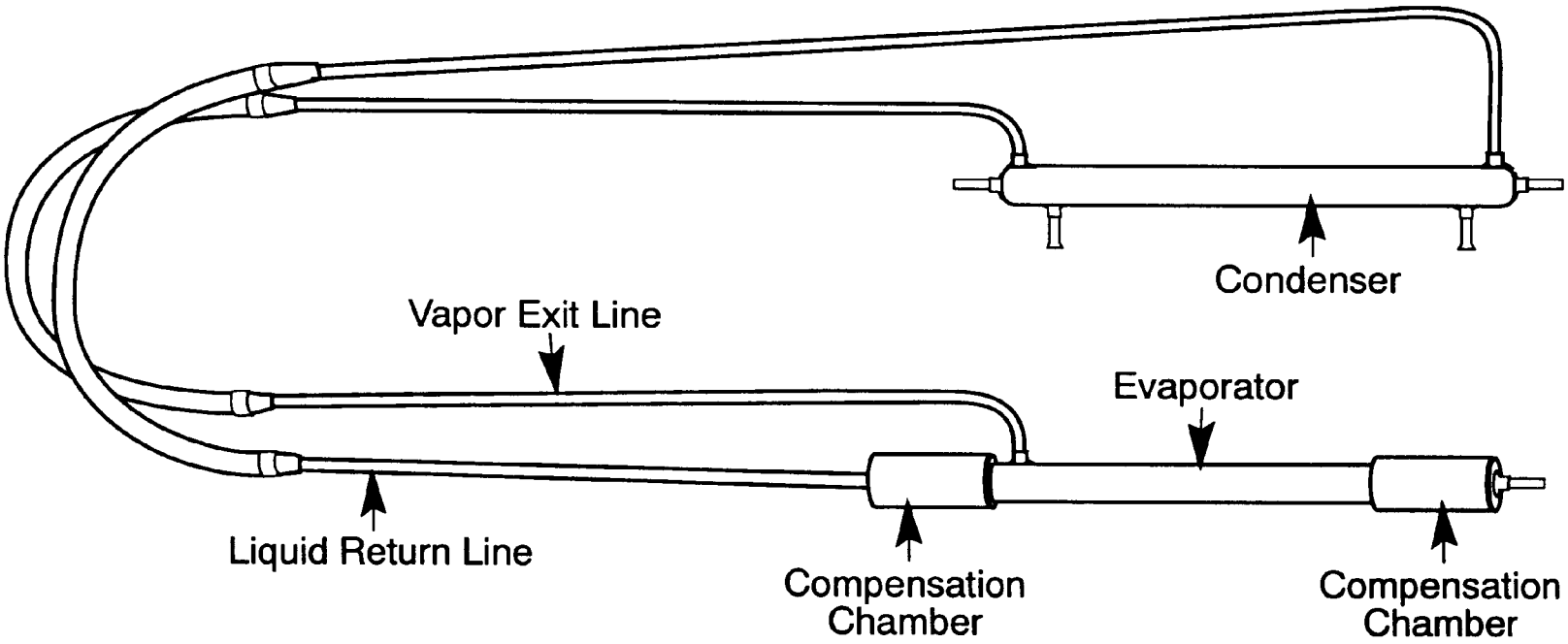
Fig. 8 PRIOR ART
FIG. 8 is a photograph of a Russian dual compensation chamber LHP.
Figure 9:
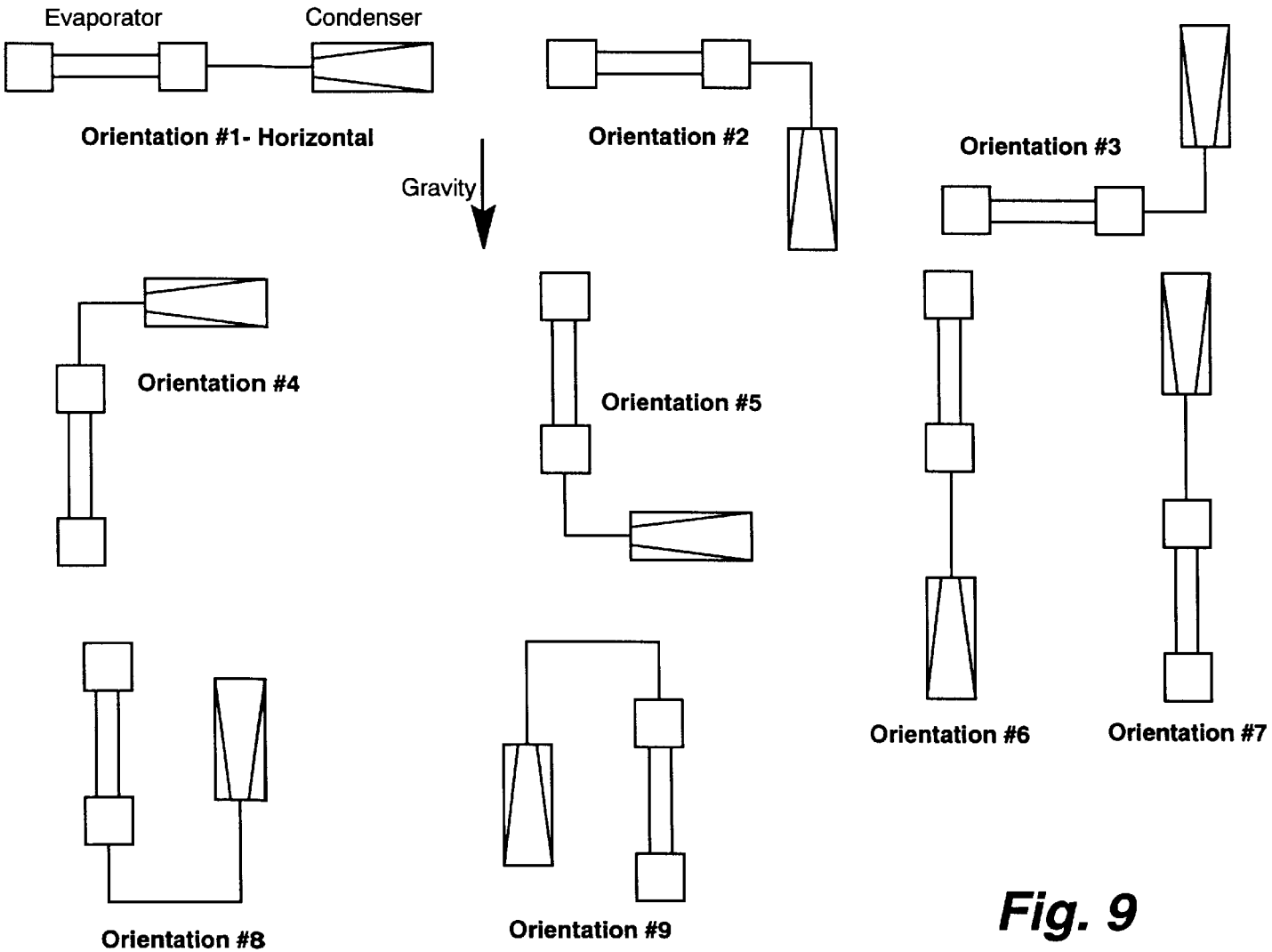
FIG. 9 shows nine orientations of a dual compensation chamber LHP in earth gravity.
Figure 10:
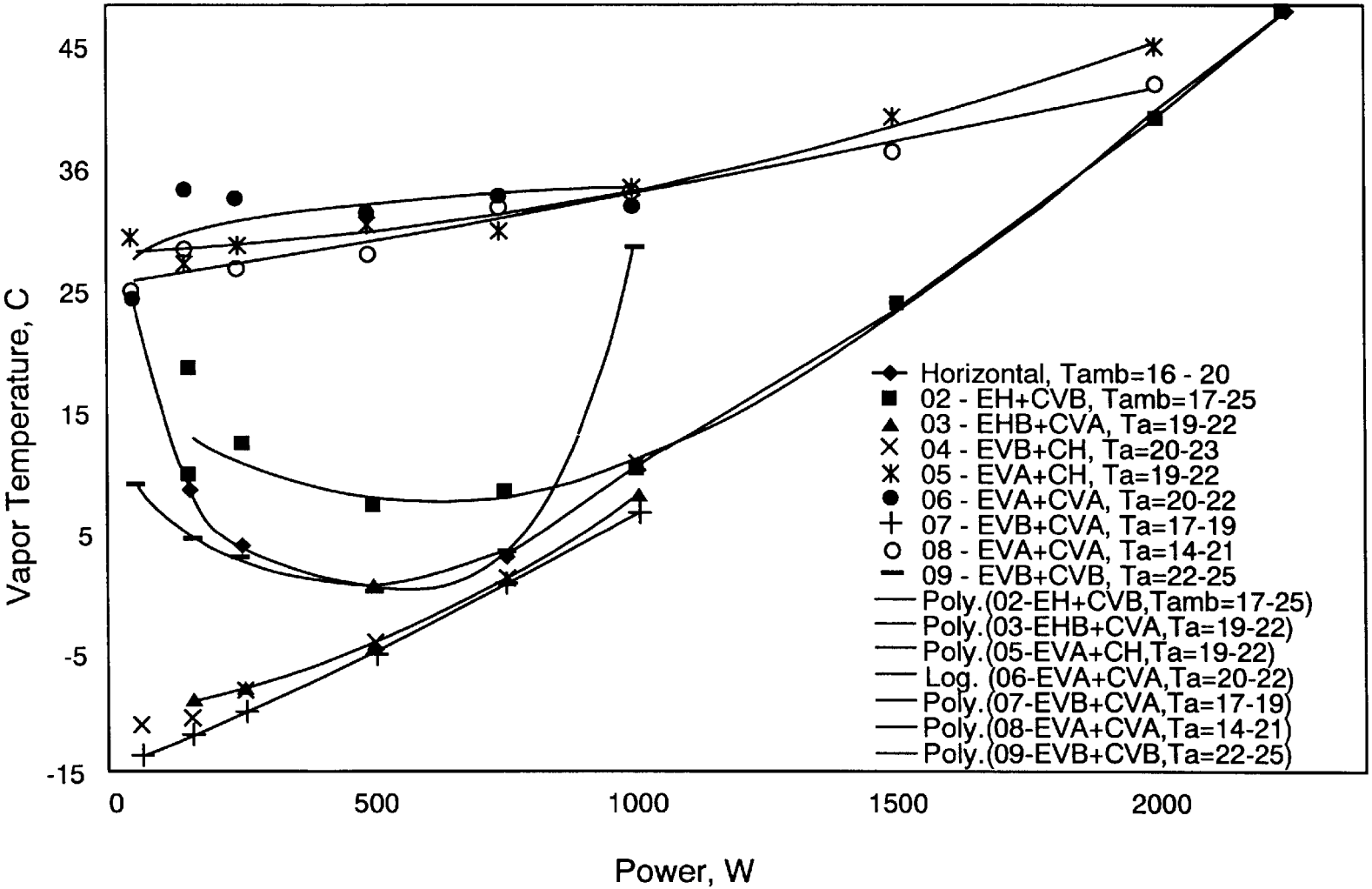
FIG. 10 is a plot of the steady-state saturation temperature of a dual compensation chamber LHP for nine orientations in earth gravity.
Figure 11A:
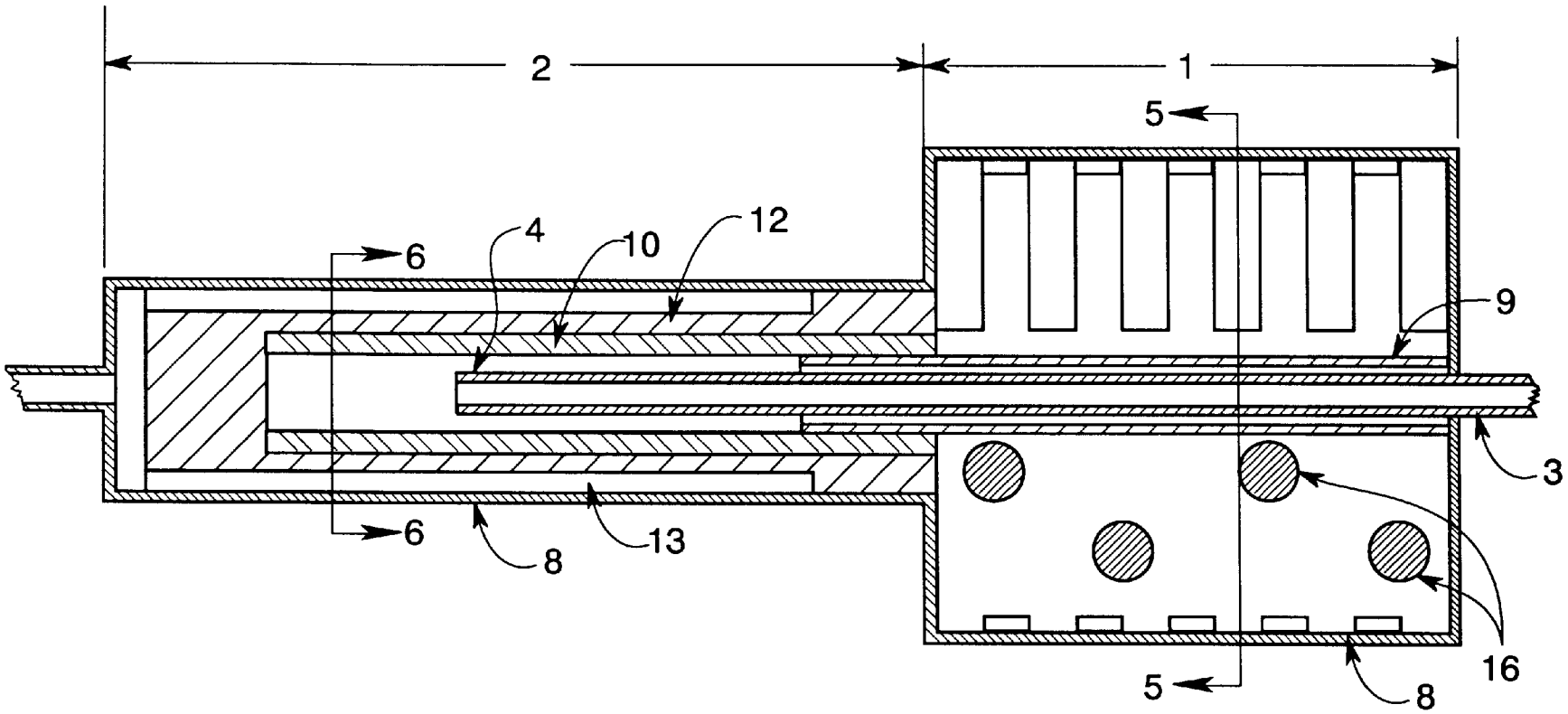
FIGS. 11*a*–11*d* is an overview schematic of the invention as integrated into a representative loop heat pipe.
Figure 11B:
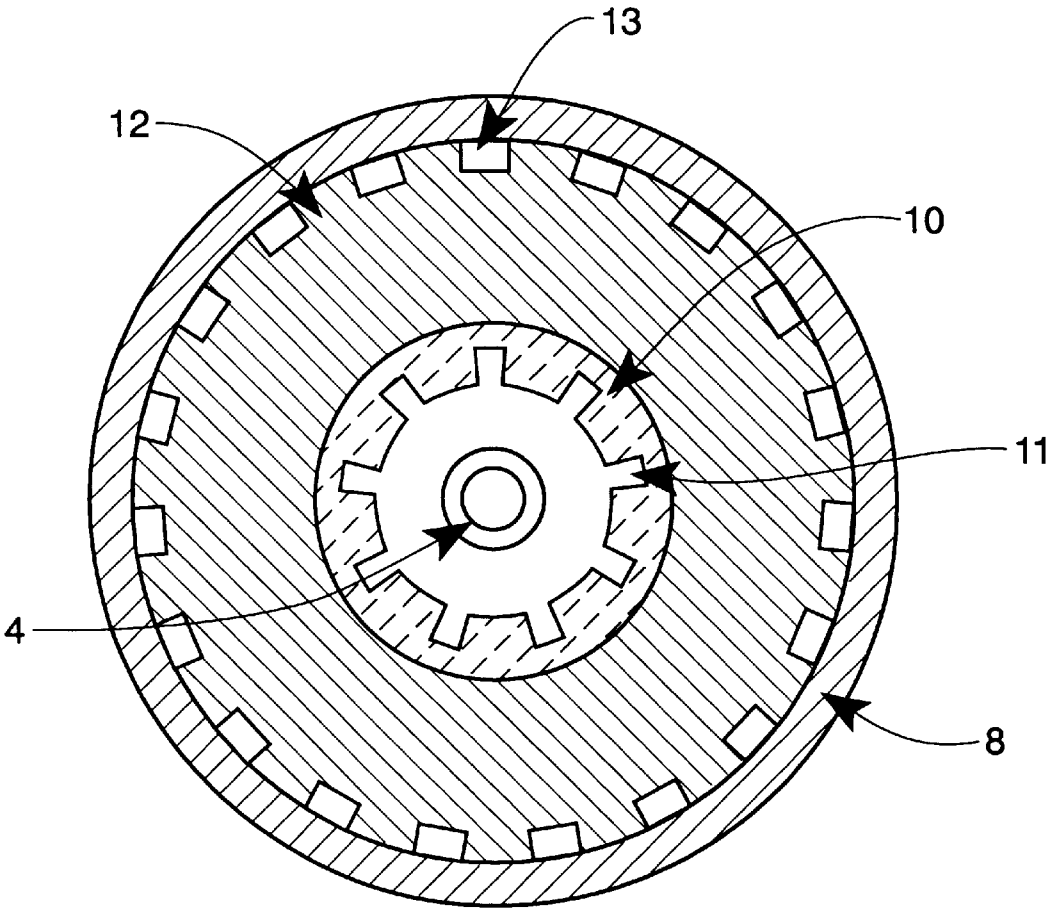
Figure 11C:
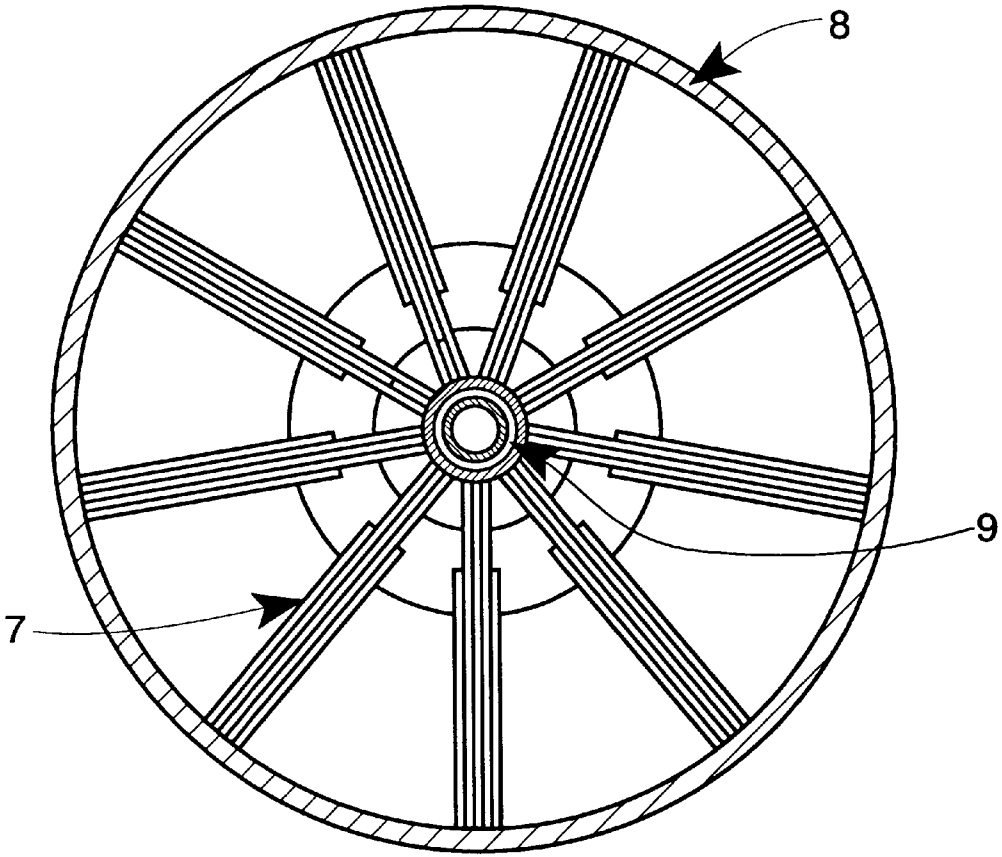
Figure 11D:
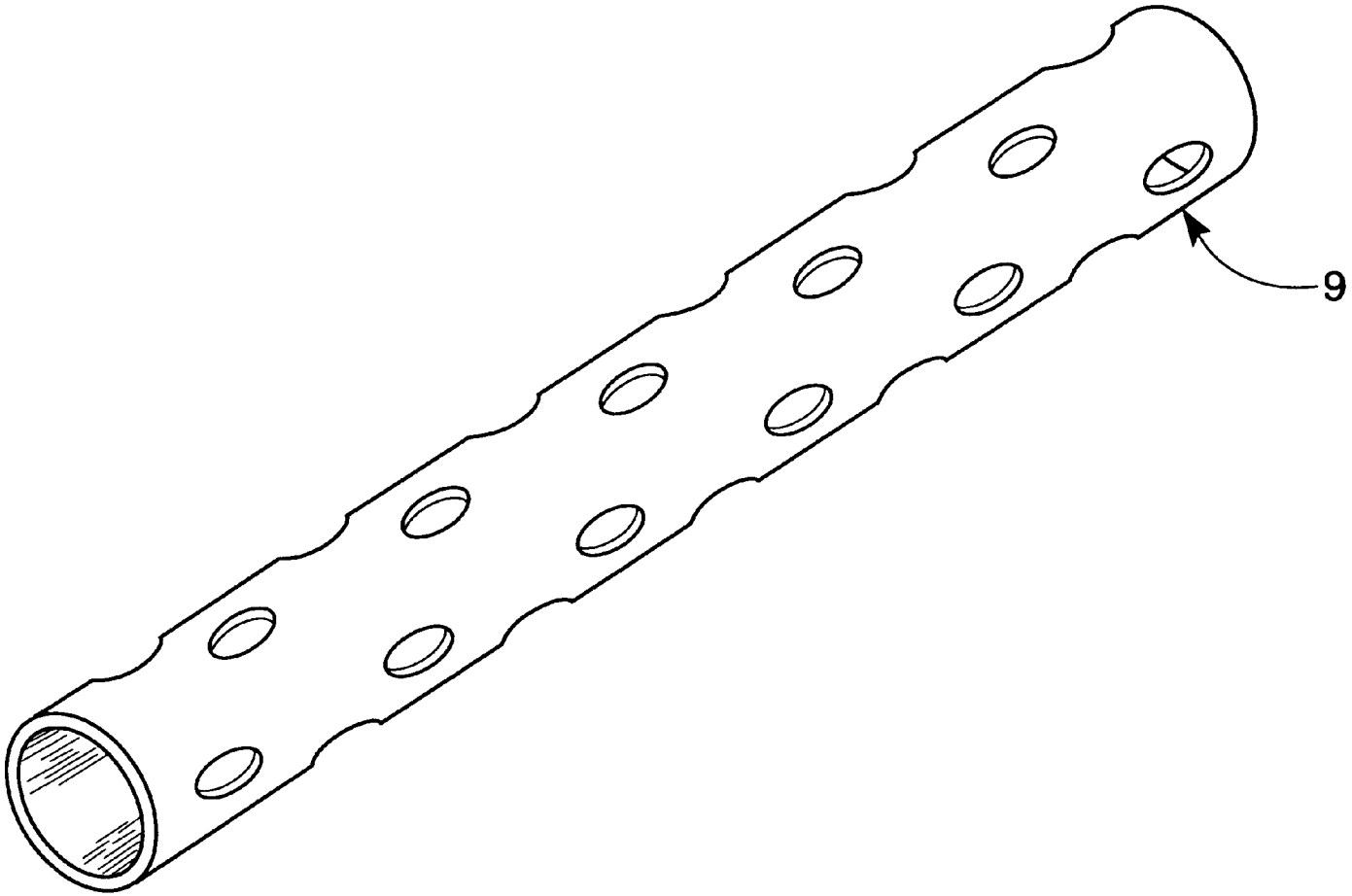

FIGS. 11*a*–11*d* shows a schematic of the invention as integrated into a representative loop heat pipe. The loop heat pipe is comprised of two elements, the compensation chamber 1 and the evaporator 2. The evaporator 2 is shown concentric with the compensation chamber 1. The returning liquid 3 enters a concentric bayonet 4, which passes through the compensation chamber before reaching the evaporator in this embodiment. The return liquid is discharged from the bayonet 4 at the far end of the evaporator. The compensation chamber is not a flow through device in the usual sense with an input and output end. It is usually described in terms of inboard and outboard ends where the inboard end interfaces with the evaporator. Flow into or out of the compensation chamber occurs at the inboard end. In the preferred embodiment of the invention (FIG. 11) the evaporator is shown concentric with the compensation chamber. However, in many designs the evaporator is offset (at the bottom of the compensation chamber with respect to earth gravity). The multifunctional capillary system works perfectly well in a non-concentric design where the bayonet may enter the evaporator through a transition section between the compensation chamber and the evaporator. This bayonet would have to make a right turn after entering the transition section.

Sections are taken through the compensation chamber 5—5 and the evaporator 6—6 to illustrate the features of the invention. The compensation chamber has nine vane assemblies 7 whose function is to control the location of the vapor-liquid interface and to acquire and pump liquid by two parallel paths to the wick in the evaporator. The microgravity path is through the channel between vanes, while the earth gravity path is within the vanes themselves. Hence, the vanes must be porous. The vane assemblies are supported at the outside by the casing 8 and in the center by a slotted circular tube 9. This slotted tube extends from the liquid return end of the compensation chamber, and overlaps slightly and is supported by the evaporator-core secondary wick 10 at the compensation chamber end of the evaporator. The bayonet is supported at the liquid return end by the end cap of the compensation chamber. The support method is not critical to the functioning of the invention, as long as wick blockage or spurious wicking paths are avoided.

As with the vane assemblies, the evaporator-core secondary wick 10, has two parallel wicking paths. The microgravity path is along the nine trapezoidal axial grooves 11, while the earth gravity path is within the body of the evaporator-core secondary wick. As with the vanes, the body of the evaporator-core secondary wick must be porous. This secondary wick is concentric, contiguous, and in intimate contact with the primary wick 12. The primary wick has twenty vapor removal grooves 13 in this embodiment. The secondary wick is shown here running the entire length of the primary wick. This is generally desirable, but not absolutely necessary. The secondary wick can be somewhat short of the full length of the primary wick and still properly supply liquid to the primary wick. It is in the primary wick that fluid capillary pressures are developed to drive the loop heat pipe. The function of the primary wick, per se, is not part of this invention. Assuring an adequate supply of liquid to the primary wick under a wide range of conditions is central to this invention.

Figure 12:
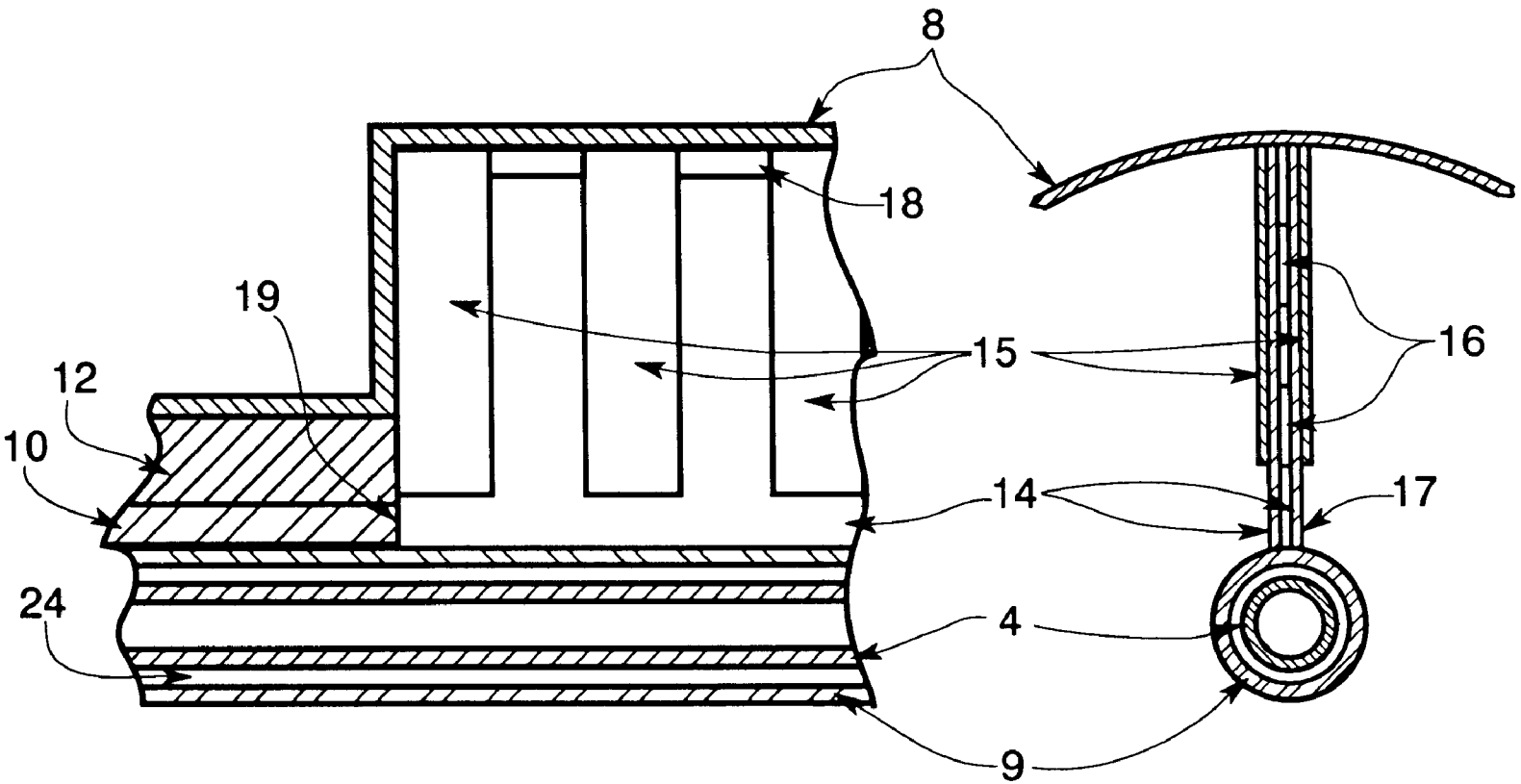
FIG. 12 is a side view cutaway showing a detailed vane assembly.

FIG. 12 is a side view cutaway showing a detailed vane assembly. The vane assembly consists of two vanes 14, vane risers 15, a number of disk-shaped spacers 16, and the channel between the vanes 17. The vanes are slotted 18 at the outboard edge. Vane risers are joined to the outside of the vanes, creating open-channel wicking paths in the region between the risers. These paths pump liquid by capillary pressure from fillet regions near the circular tube 9 to the slots 18 at the outboard edge of the vanes. The spacers 16 separate and support the vanes forming a channel for microgravity liquid supply, said liquid entering this channel through the slots. The earth gravity wicking path is within the vanes proper.

The vane assemblies join the evaporator-core secondary wick at the compensation chamber-evaporator interface 19. The parallel wicking paths of the vane assemblies are matched to the corresponding paths of the evaporator-core secondary wick. That is, the flow in each channel between the vanes transitions to flow down an axial-groove, while flow within the vanes proper transitions to flow within the body of the secondary wick. Correct joining of the parallel wicking paths of the vane assemblies to the corresponding wicking paths of the evaporator-core secondary wick is necessary for proper functioning of this invention.

Figure 13:
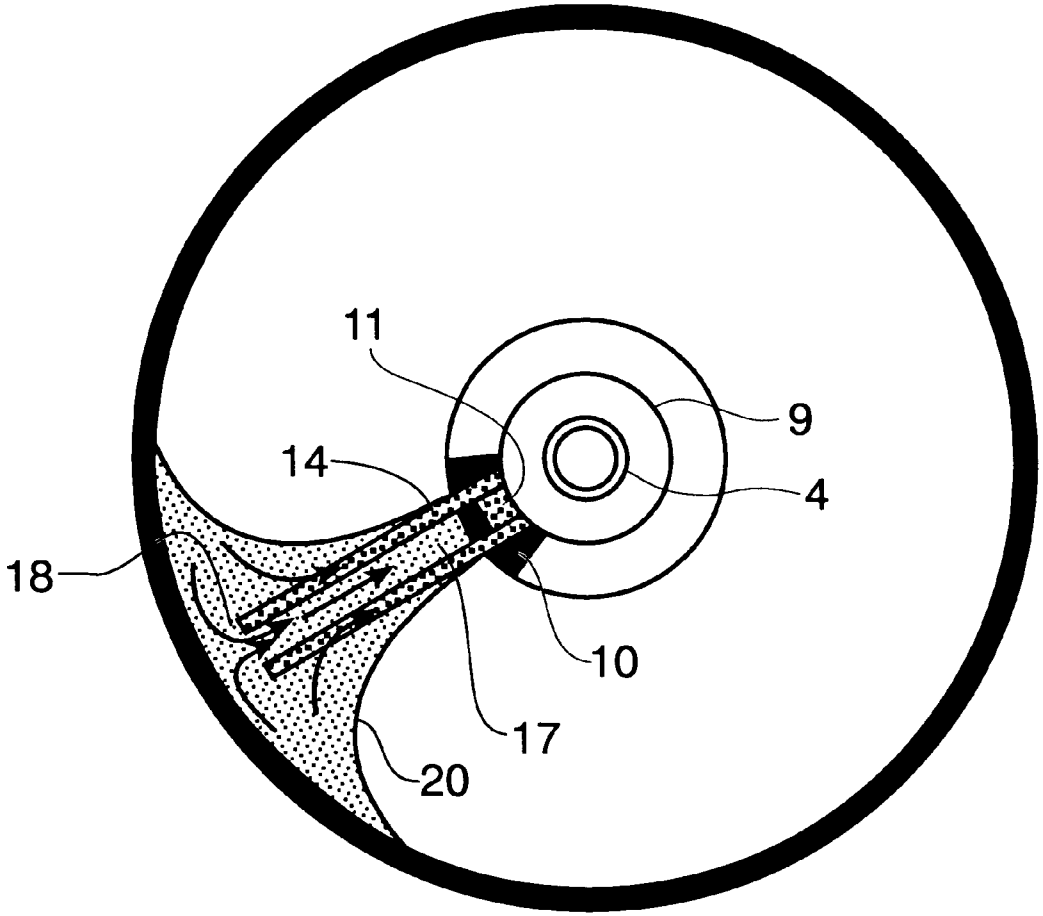
FIG. 13 is a schematic of a vane assembly showing its function and interface with the evaporator-core secondary wick.

FIG. 13 is a schematic of a simplified vane assembly within the compensation chamber showing its function and its interface with the evaporator-core secondary wick. For clarity the spacers and risers are not shown, the vane assembly being shown only with two vanes 14 and the channel 17 between the vanes. A typical vapor-liquid meniscus 20 is shown in the compensation chamber. Liquid flow is shown by arrows wicking through a slot 18 in the vanes into the channel between the vanes; and wicking along the vanes proper. The channel between the vanes is the microgravity (space environment) path. As little or no hydrostatic head due to gravity is involved the preferred pore size is rather large. An open channel is the preferred embodiment in the limit as pore size increases. For a perfectly wetting liquid such a channel develops a capillary pressure of $\Delta P=2\sigma/w$, where $\sigma$ is the surface tension and w is the channel width. Flow pressure loss is low for this open channel with permeability given by $w^2/8$.

The vanes themselves are the 1-g (earth environment) path. It was shown earlier that velocity is given by $u=[0.00667\sigma d^2\epsilon^3/\mu L(1-\epsilon)^2][4\sigma/d-\Delta\rho gL]$, where d is the pore diameter, $\epsilon$ is the porosity, $\mu$ the viscosity, L is the length of the vane in the direction of flow, $\Delta\rho$ is the difference between liquid and vapor density, and g is acceleration due to earth gravity, 9.8 meter/second$^2$. The dependence of liquid velocity on pore diameter is complex. The porous medium constituting the vane should have a high capillary pressure to lift the liquid "uphill" against the earth gravitational field. For a given lift capability, the permeability should be as high as possible. Metal fibers suitably compressed and sintered are very promising in this regard. Such fibers are available from companies such as Bekaert Inc., Brussels, Belgium. Their use as metal felt wicks has been investigated by Sandia National Laboratories. Measured values of permeability were from $0.5\times10^{-10}$ to $3\times10^{-10}$ m$^2$ with effective pore radius from 47 to 80 microns.

Detailed analyses of secondary wick performance in 1-g shows that if any significant height is to be realized, a wick of graded or incremental porosity is needed. The loop heat pipe oriented vertically in 1-g with the compensation chamber below the evaporator, imposes a severe design case. It is necessary to wick liquid "uphill" within the secondary wick over the entire active length of the evaporator. If a wick with the necessary small pore size is used over the entire height, the flow pressure losses become too large. The lower regions of the wick, as the height difference is small, require a relatively large pore size. The smallest pores are required only at the top. Therefore the wick is to be built up of several layers with successively smaller pore size.

FIG. 13 shows, as well, how the vane assembly joins the evaporator-core secondary wick 10. The channels between the vanes have the same width as, and register with, the axial grooves 11 of the evaporator-core secondary wick. As the meniscus radius of curvature is the same in the channel as in the grooves the liquid can wick from the channels to the grooves; this liquid "bridging" was successfully tested, confirming the micro-gravity path. It is necessary, as well, that liquid within the vanes wick into the body of the evaporator-core secondary wick. The design achieves this by assuring intimate contact between the evaporator-core secondary wick and the vane assemblies, with the pore size of the evaporator-core secondary wick layer nearest the compensation chamber is equal to or less than that of the vanes. This bridging between the two felt metal parts was also successfully tested. The structural and hydraulic integrity of this and other joints in this invention can be achieved by proper dimensional tolerance to achieve a compression fit and then sintering in place.

Figure 14:
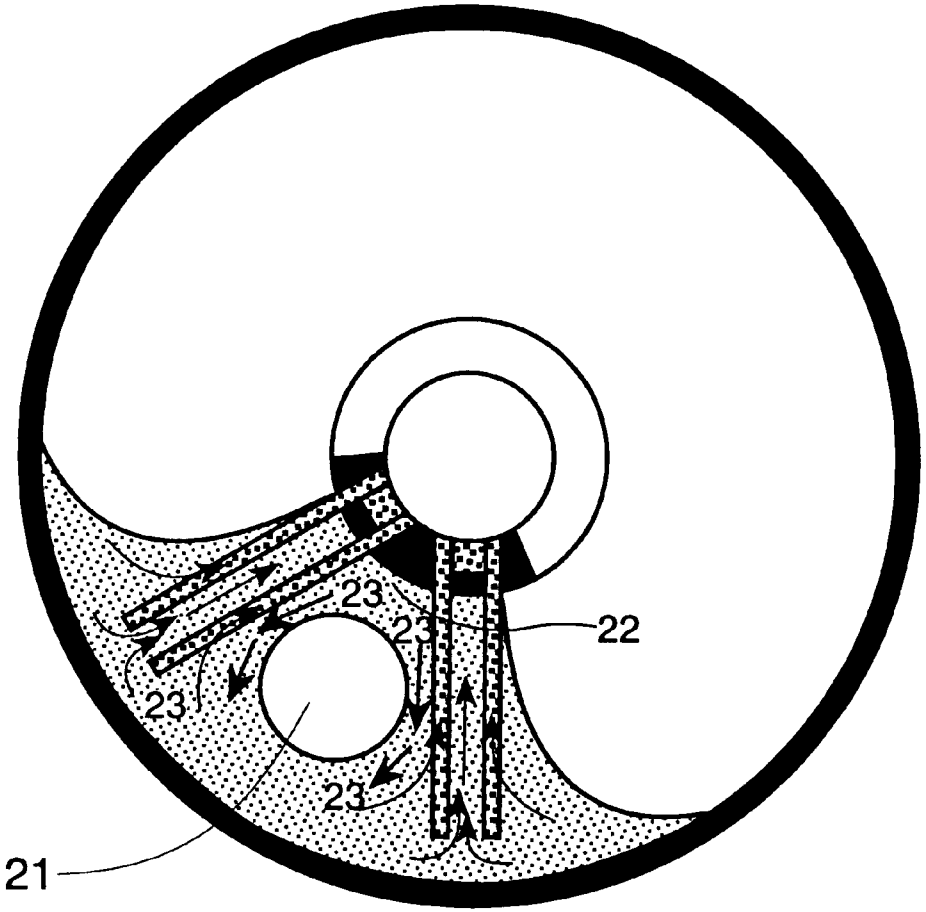
FIG. 14 is an end view showing how vane assemblies control vapor-liquid location.

FIG. 14 provides an example of how the vane assemblies can favorably control the location of vapor bubbles. It is desired that vapor be contained within the compensation chamber and not reach the vicinity of the evaporator core. Vapor penetration of the primary wick can cause the wick to dry out and the loop heat pipe to deprime. The vane assembly preferentially absorbs liquid rather than vapor by virtue of capillary pressure. The vapor bubble 21 is confined benignly, as show in this example, between vane assemblies.

FIG. 14 also shows a fillet of liquid 22 trapped between the vane assemblies and the support tube. This liquid wicks down (bold arrows 23) between vane risers (please see FIG. 12) reaching the vicinity of the slots and eventually depleting the fillet.

Figure 15:
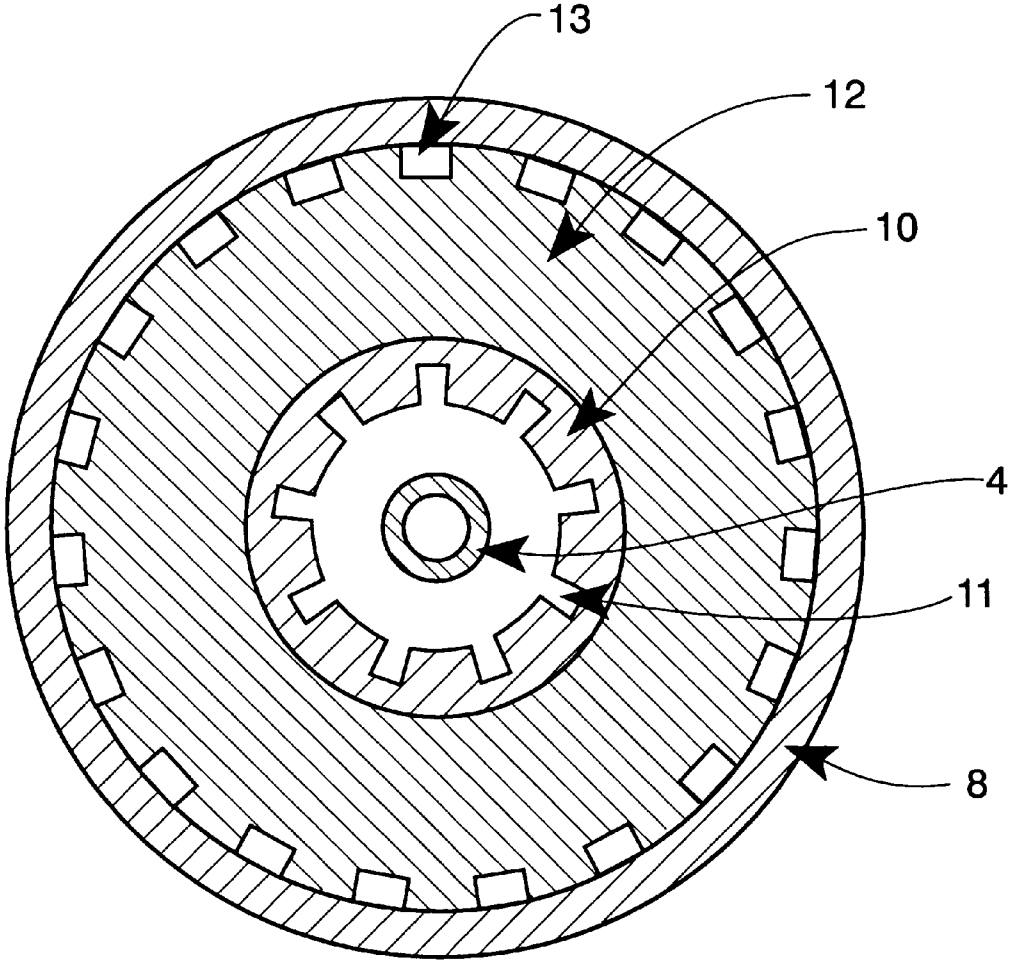
FIG. 15 is a section through the evaporator showing the evaporator-core secondary wick functionally integrated with the primary wick.

FIG. 15 shows a section through the evaporator. From the center outward we have the bayonet 4, the evaporator-core secondary wick 10, the primary wick 12. The secondary wick has nine trapezoidal axial grooves 11, while the primary wick has twenty vapor removal grooves 13. This secondary wick is concentric, contiguous, and in intimate contact with the primary wick. The trapezoidal axial grooves are the continuation of the micro-gravity path into the evaporator. They transport liquid along the evaporator-core secondary wick, providing a ready supply of liquid along the length of the primary wick. The material part of evaporator-core secondary wick is a continuation of the earth 1-g path into the evaporator. This wick is formed from the same metal felt as used in the vanes. Liquid is pumped radially by capillary forces from the axial grooves (if the micro-gravity path is active) into the secondary wick and thence to the primary wick. Otherwise (the 1-g path is active) liquid is pumped radially, directly from the secondary to the primary wick. In either case, this liquid evaporates at the outer surface of the primary wick by virtue of the applied heat, creating the meniscus curvature and capillary pressure rise necessary to drive the loop heat pipe.

A developmental evaporator assembly has been fabricated. Using this assembly as basis, a specific embodiment of the invention has been designed. This embodiment includes a complete compensation chamber-evaporator assembly for a loop heat pipe. Specifications for the design are given in FIG. 16. The wick material was Bekaert Inc. fiber 4/150 or 8/300, type 316L sintered and compressed. The numbers "4" and "8" refer to the wire diameter 4 and 8 microns and "150" and "300" are the weight in grams/m$^2$. The 8/300 metal felt, moderately compressed, is used for the vanes, as hydrostatic head associated with the relative short lengths involved is satisfied by a relatively coarse material. The primary wick requires a highly compressed 4/150 felt as a 16 micron pore diameter is sought. The secondary wick in the evaporator is a graded or incremental porosity type. The loop heat pipe oriented vertically in 1-g with the compensation chamber below the evaporator, imposes a severe design case. It is necessary to wick liquid "uphill" within the secondary wick over the entire active length of the evaporator, 187.5-mm in this case. If a wick with the necessary small pore size is used over the entire length, the flow pressure losses become too large. Therefore the wick is to be built up of five layers with successively smaller pore size. At the compensation chamber end of the wick evaporator, pore diameter is 388 microns, the same as that of the vanes. Pore diameter is reduced in successive layers: 181, 85, 39, and 18 microns.

This design was analyzed for liquid supply to the primary wick through the two paths: micro-gravity and 1-g. The working fluid was ammonia over the temperature range −40° to +40° C. The design was found to be adequate for both paths over the temperature range for 400 Watts of heat transport. The analysis assumed the most adverse location of the liquid for both micro-gravity and 1-g conditions with the compensation chamber-evaporator assembly assumed vertical with the compensation chamber below the evaporator in 1-g. It is very likely that the design will function properly at power loads well above 400 W—as the wicks contain a distribution of pore sizes and a liquid inventory that can be partially depleted without breakdown.

In the embodiment above, the invention is shown applied to a specific loop heat pipe. The invention will work equally well with other types of loop heat pipes including those with liquid return lines and bayonets that are not concentric with the longitudinal axis of the compensation chamber-evaporator assembly and those where the liquid enters the compensation chamber at a right angle to the axis of the compensation chamber. It is immaterial to the functioning of this invention what routing the return liquid takes.

Other types of loop heat pipes in which the invention will work include: (a) those where the liquid return line by-passes the compensation chamber and enters the compensation chamber-evaporator assembly in a transition section; (b) those where powder metal rather than fibrous metal is used for the primary wick; (c) those where the primary wick is non-metallic; (d) those with dual compensation chambers; and (e) those with multiple evaporators and/or condensers. The invention is also applicable to loop heat pipes of various sizes and shapes, to ramified loop heat pipes, and to reversible loop heat pipes.

The embodiment is shown with nine vane assemblies in the compensation chamber. There is nothing unique about this number of assemblies. The invention functions well with other numbers of vane assemblies. The actual number to be used depends on trade-offs depending on actual requirements.

Fibrous metal wicks are used in the embodiment show above. However, other porous media can be used. The fibers can be non-metallic and, indeed, the wick need not be constructed of fibers. The wick might be made of powders or woven fabrics.

The micro-gravity wicking path is shown in the embodiment as open structure of channels and grooves. However, the micro-gravity path can be provided by alternate means. For example, the Perm State Technical University in the Russian Federation can supply High Porosity Cellular Materials (HPCM) in a wide range of pore sizes, thermal conductivities, etc. Such materials can be used as a replacement for the axial grooves. The axial grooves can be other shapes in addition to trapezoidal.

The porous material constituting the evaporator-core secondary wick need not be made of the same medium as used for the vanes. Other media may be used, as long as the effective pore diameter in the evaporator-core secondary wick layer nearest the compensation chamber is less than or equal to that of the vanes.

The vane assemblies can be supported at the center by other means than a slotted circular tube, as shown by 9 in FIGS. 11 and 12. Other types of porous tubes can be used, and in some cases support can be provided by the bayonet, shown as 4 in FIGS. 11 and 12.

The evaporator-core secondary wick need not incrementally vary in pore radius over five layers. For less stringent applications it can be fabricated with fewer layers or an homogeneous pore structure, while for more severe applications more layers or a continuously variation may be employed.

Sintering was used as the primary method of joining in the embodiment. However, and especially if non-metallic media are used, other methods of joining including an interference fit can be used.

We claim:

1. A multifunctional capillary system located within a compensation chamber and an evaporator unit of a loop heat pipe system capable of operating throughout a zero to one-g gravitational environment at any orientation, said capillary system comprised of:

a. a compensation chamber having inboard and outboard ends and an external casing;

b. an evaporator unit, interfaced to the inboard end of said compensation chamber containing primary and secondary wicks of porous material and having an external casing;

c. a two-phase working fluid;

d. a bayonet extending into said evaporator unit;

e. a slotted circular tube within said compensation chamber and extending into and overlapping said secondary wick of said evaporator unit for a short distance;

f. a plurality of vane assemblies within said compensation chamber attached between said slotted circular tube and the external casing of said compensation chamber, each vane assembly comprised of two vanes with slots at the outer end, a channel, spacers, and vane risers;

g. a joint between said plurality of vane assemblies and said evaporator unit secondary wick at the evaporator unit compensation chamber interface;

h. said evaporator unit secondary wick having an inner surface contiguous to said slotted circular tube where said slotted circular tube protrudes into said evaporator unit and extending essentially throughout the length of said evaporator unit and having an outer surface encompassed by and in intimate contact with the inner diameter of said primary wick, said secondary wick further having a plurality of axial grooves cut out of its inner surface; and i. said primary wick having an outer surface in contact with the evaporator unit casing and having a plurality of vapor removal grooves along its outer surface.

2. The multifunctional capillary system of claim 1, wherein said vanes and said evaporator unit secondary wick provide a liquid wicking structure in a one-g gravitational environment and said channels between said vanes and said axial grooves on the inner surface of said evaporator unit secondary wick provide a liquid wicking structure in a micro-gravity environment.

3. The multifunctional capillary system of claim 1, wherein said vanes and evaporator unit secondary wick are constructed of a porous material having pores larger than the pore size of said primary wick.

4. The multifunctional capillary system of claim 1, wherein said vanes are made of a porous medium with pore size equal to or greater than that of said evaporator unit secondary wick at the compensation chamber interface.

5. The multifunctional capillary system of claim 1, wherein said vanes are slotted or otherwise open where they meet said compensation chamber casing.

6. The multifunctional capillary system of claim 1, wherein said vanes channels in said vane assemblies at said joint correspond in number, size and alignment with the axial grooves in said evaporator unit secondary wick.

7. The multifunctional capillary system of claim 1, wherein said vanes risers are spaced along the vanes and joined to the outside of the vanes.

8. The multifunctional capillary system of claim 1, wherein said evaporator unit secondary wick is made of a porous medium that has decreasing pore size as distance from said compensation chamber interface increases.

9. The multifunctional capillary system of claim 1, wherein said joint between said plurality of vane assemblies and said evaporator unit secondary wick is close fitting so as to provide liquid bridging.

* * * * *